US008254815B2

(12) United States Patent
Takuwa

(10) Patent No.: US 8,254,815 B2
(45) **Date of Patent: *Aug. 28, 2012**

(54) TONER CARTRIDGE AND IMAGE FORMING APPARATUS FOR MOUNTING THE SAME

(75) Inventor: Noriyuki Takuwa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/241,939

(22) Filed: Sep. 23, 2011

(65) Prior Publication Data

US 2012/0014721 A1 Jan. 19, 2012

Related U.S. Application Data

(63) Continuation of application No. 12/873,659, filed on Sep. 1, 2010, now Pat. No. 8,050,598, and a continuation of application No. 12/338,862, filed on Dec. 18, 2008, now Pat. No. 7,813,679, and a continuation of application No. 11/500,636, filed on Aug. 8, 2006, now Pat. No. 7,483,659.

(30) Foreign Application Priority Data

Aug. 31, 2005 (JP) ..... 2005-252177
Aug. 31, 2005 (JP) ..... 2005-252178

(51) Int. Cl.
*G03G 15/08* (2006.01)

(52) U.S. Cl. ..... 399/262

(58) Field of Classification Search ..... 399/119, 399/262

See application file for complete search history.

(56) References Cited

U.S. PATENT DOCUMENTS

| | | | | |
|---|---|---|---|---|
| 5,794,108 | A | 8/1998 | Yoshizawa et al. | |
| 6,259,877 | B1 | 7/2001 | Taniyama et al. | |
| 6,298,208 | B1 | 10/2001 | Kawamura et al. | |
| 6,334,037 | B1 | 12/2001 | Ise | |
| 6,370,349 | B2 | 4/2002 | Tsuji et al. | |
| 6,456,811 | B1 | 9/2002 | Kato | |
| 6,785,497 | B1 | 8/2004 | Hasebe | |
| 7,483,659 | B2 | 1/2009 | Takuwa | |
| 7,813,679 | B2 | 10/2010 | Takuwa | |
| 8,050,598 | B2 * | 11/2011 | Takuwa | 399/262 |

(Continued)

FOREIGN PATENT DOCUMENTS

JP 07-020705 1/1995

(Continued)

OTHER PUBLICATIONS

U.S. Office Action dated Sep. 4, 2009 corresponding to U.S. Appl. No. 12/338,862, filed Sep. 4, 2009.

(Continued)

*Primary Examiner* — Sandra Brase
(74) *Attorney, Agent, or Firm* — Turocy & Watson, LLP

(57) ABSTRACT

A toner cartridge in a bottle shape for storing toner is composed of a first cylindrical portion having a blocked bottom wall at one end and an opening at the other end and a second cylindrical portion in which one end thereof is connected to the opening, and an opening for ejecting toner is formed at the other end, and the outside diameter thereof is smaller than the first cylindrical portion.

12 Claims, 10 Drawing Sheets

U.S. PATENT DOCUMENTS

| | | | |
|---|---|---|---|
| 2005/0084296 | A1 | 4/2005 | Takuwa |

FOREIGN PATENT DOCUMENTS

| | | |
|---|---|---|
| JP | 09-251240 | 9/1997 |
| JP | 2001-125354 | 5/2001 |
| JP | 2004-280064 | 10/2004 |

OTHER PUBLICATIONS

U.S. Office Action dated Feb. 25, 2010 corresponding to U.S. Appl. No. 12/338,862, filed Sep. 4, 2009.

U.S. Office Action dated Feb. 25, 2010 corresponding to U.S. Appl. No. 12/873,659, filed Sep. 1, 2010.

* cited by examiner

TONER CARTRIDGE AND IMAGE FORMING APPARATUS FOR MOUNTING THE SAME

CROSS-REFERENCE TO RELATED APPLICATION

This is a Continuation application of co-pending application Ser. No. 12/873,659 filed on Sep. 1, 2010, which is a Continuation application of co-pending application Ser. No. 12/338,862 filed on Dec. 18, 2008, which application is a Continuation application of co-pending application Ser. No. 11/500,636 filed on Aug. 8, 2006, which application is based upon and claims the benefit of priority from the prior Japanese Patent Applications No. 2005-252177 filed on Aug. 31, 2005 and No. 2005-252178 filed on Aug. 31, 2005, the entire contents of all five of which are incorporated herein by reference.

BACKGROUND OF THE INVENTION

1. Field of the Invention

The present invention relates to a toner cartridge and an image forming apparatus for mounting the toner cartridge.

2. Description of the Related Art

Copier manufacturers, from the view point of product control and security of print quality, list several toner cartridges recommended to use for their manufactured copiers. The reason is that use of a toner cartridge of poor quality may cause copier breakdowns and deterioration of the print quality.

However, a toner cartridge mounted in a copier, regardless of the type of copier, has a similar shape and size. Therefore, it is difficult for a user to discriminate correctly the kind of toner cartridge and depending on the condition, a wrong toner cartridge may be mounted. Therefore, in recent years, several copiers capable of preventing use of a toner cartridge which is not a true product without depending on the judgment of the user have been developed.

For example, a copier for preventing mounting itself of a toner cartridge which is not a true product by use of the fitting condition of the concavity and convexity formed in the cap of the toner cartridge and the concavity and convexity formed in the coupling of the cartridge driver is known.

In this copier, when mounting and demounting the toner cartridge, a cartridge holder is used. The cartridge holder is rotatably supported by the connection section arranged in the copier body and moves the held toner cartridge back and forth between the mounting position in the copier body and the release position outside the copier body.

The cartridge driver is provided in the neighborhood of the connection section for supporting the cartridge holder and in the coupling thereof, the cap of the toner cartridge is inserted.

Further, in the copier body, when the toner cartridge is mounted in the copier body, in the position opposite to the cartridge driver, a pusher for pressing the toner cartridge toward the cartridge driver is provided.

When mounting the toner cartridge, if the concavity and convexity provided in the cap and the concavity and convexity provided in the coupling do not correspond to each other, the end of the toner cartridge is projected from the cartridge holder, thus the toner cartridge and pusher interfere with each other. By doing this, the toner cartridge is obstructed by the pusher and is not mounted smoothly in the copier body.

However, if the concavity and convexity provided in the cap and the concavity and convexity provided in the coupling correspond to each other, the end of the toner cartridge is not projected from the cartridge holder, thus the toner cartridge and pusher do not interfere with each other. Therefore, the toner cartridge is not obstructed by the pusher and is mounted smoothly in the copier body.

As mentioned above, in this copier, the toner cartridge which is not a true product is not mounted in the copier body, so that the toner cartridge which is not a true product will not be used.

Further, in Japanese Patent Application 2001-125354, a copier for preventing use of a toner cartridge which is not a true product by use of the switch driver provided in the toner cartridge and the switch provided in the developing device is disclosed.

In this copier, only when the switch of the developing device is turned on by the switch driver of the toner cartridge, toner supply to the developing device is started. Therefore, if the toner cartridge is provided with the switch driver, simultaneously with mounting of the toner cartridge in the copier, the switch of the developing device is turned on and toner supply to the developing device is started.

However, if the toner cartridge has no switch driver, even if the toner cartridge is correctly mounted in the copier body, the switch of the developing device is not turned on, so that toner supply to the developing device is not started.

As mentioned above, in this copier, if the toner cartridge has no switch driver, when the developing device is not turned on, even if a toner cartridge which is not a true product is mounted, the toner cartridge is not used actually.

As mentioned above, in the copier having the cartridge holder, if the toner cartridge is projected from the cartridge holder, when the toner cartridge is mounted, the toner cartridge and pusher interfere with each other, thus the toner cartridge cannot be mounted.

However, when the pusher is deformed, even if the toner cartridge is projected from the cartridge holder, the toner cartridge may be mounted. Further, even when the pusher is not deformed, depending on the shape and dimensions of the toner cartridge, large force can be applied, thus the toner cartridge may be mounted. As mentioned above, the copier using the fitting condition of the concavities and convexities cannot prevent surely use of a toner cartridge which is not a true product.

Further, the copier disclosed in Japanese Patent Application 2001-125354 requires the switch driver and switch, so that the constitution of the copier is complicated and furthermore, the cost is increased.

The toner cartridge used in the image forming apparatus aforementioned is of a rotary type as disclosed in Japanese Patent Application 2004-280064. Generally, the rotary-type toner cartridge is in a cylinder shape and so that a user himself can exchange the cartridge, is removably mounted in the image forming apparatus. Therefore, the toner cartridge is desirably shaped so that the user can remove simply and quickly the toner cartridge from the image forming apparatus.

The toner cartridge disclosed in Japanese Patent Application 2004-280064 includes a toner bottle for storing toner, a toner cap for blocking the opening of the toner bottle, and a gear for driving the toner bottle to rotate.

The toner bottle includes a cylindrical portion uniform in thickness arranged on the opposite side of the bottle cap and a contracting diameter portion which is arranged halfway between the bottle cap and the cylindrical portion and whose inside diameter contracts in the separating direction from the cylindrical portion.

On the other hand, the outside diameter of the contracting diameter portion disclosed in Japanese Patent Application 2004-280064, similarly to the inside diameter, contracts slightly as it approaches the toner cap. However, on the outer peripheral surface of the contracting diameter portion, the gear for driving the toner bottle to rotate is arranged, so that the outside diameter of the entire toner cartridge is almost uniform. Moreover, the toner bottle has an outside diameter formed large so as to store much toner. Namely, in the toner cartridge disclosed in Japanese Patent Application 2004-280064, the outside diameter is too large for a user and the part for putting a finger on is provided little. Therefore, the removal operation for the toner cartridge is difficult.

Further, on the inner peripheral surface of the contracting diameter portion of the toner cartridge disclosed in Japanese Patent Application 2004-280064, no spiral projection portion for conveying toner is formed. Therefore, even if the toner cartridge rotates, toner stored in the toner bottle is not conveyed smoothly to the vent.

SUMMARY OF THE INVENTION

An object of the present invention is to provide a toner cartridge which can be removed simply and conveys smoothly stored toner to the vent.

Furthermore, an object of the present invention is to provide an image forming apparatus for preventing use of a toner cartridge which is not a true product surely at a low cost.

According to an aspect of the present invention, there is provided a toner cartridge in a bottle shape for storing toner, comprising a cylindrical developer storage portion having a blocked bottom wall at one end and an opening for ejecting toner at the other end; a circular groove portion formed on the opening side from a center of the developer storage portion in a longitudinal direction, and a bottle cap to close the opening.

Further, according to an aspect of the present invention, there is provided an image forming apparatus comprising a main body having an opening and an image forming stage internally provided; a cover provided on the main body so as to open or close the opening; and a toner cartridge to be mounted in the main body when the cover is opened, wherein the toner cartridge includes a cylindrical developer storage portion having a blocked bottom wall at one end and an opening for ejecting toner at the other end; a circular groove portion formed on the opening side from a center of the developer storage portion in a longitudinal direction; a bottle cap joined to a driver provided in the main body of the image forming apparatus and is connected to the other end so as to rotate the developer storage portion; and a projection portion formed on at least either of the main body and the cover for getting into the circular groove portion formed on the toner cartridge.

DETAILED DESCRIPTION OF THE EMBODIMENTS

Hereinafter, the first embodiment and second embodiment of the present invention will be explained with reference to the accompanying drawings. Further, in the following explanation, the "left side" and "right side" are the ones based on an operator standing in front of an electro-photographic copier.

[First Embodiment]

Figure 1:
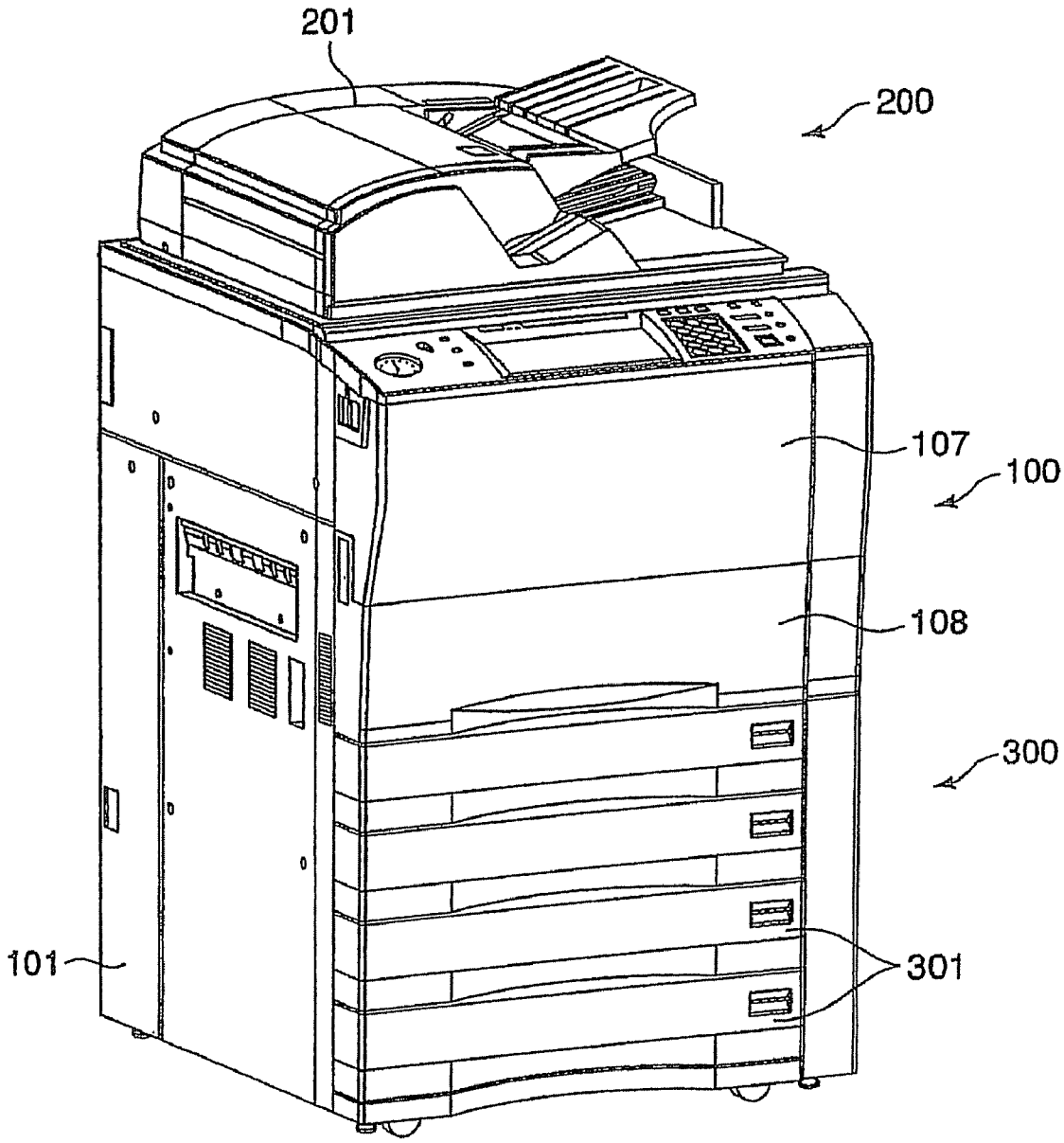
FIG. 1 is a perspective view showing the condition that the opening of the electro-photographic copier relating to the first embodiment of the present invention is closed.

Firstly, the first embodiment will be explained in detail by referring to FIGS. 1 to 8. FIG. 1 is a perspective view showing the condition that opening 106 of the electro-photographic copier relating to the first embodiment of the present invention is closed. As shown in FIG. 1, the electro-photographic copier is composed of main body unit 100, scanner unit 200, and paper supply unit 300.

(Main Body Unit 100)

Figure 2:
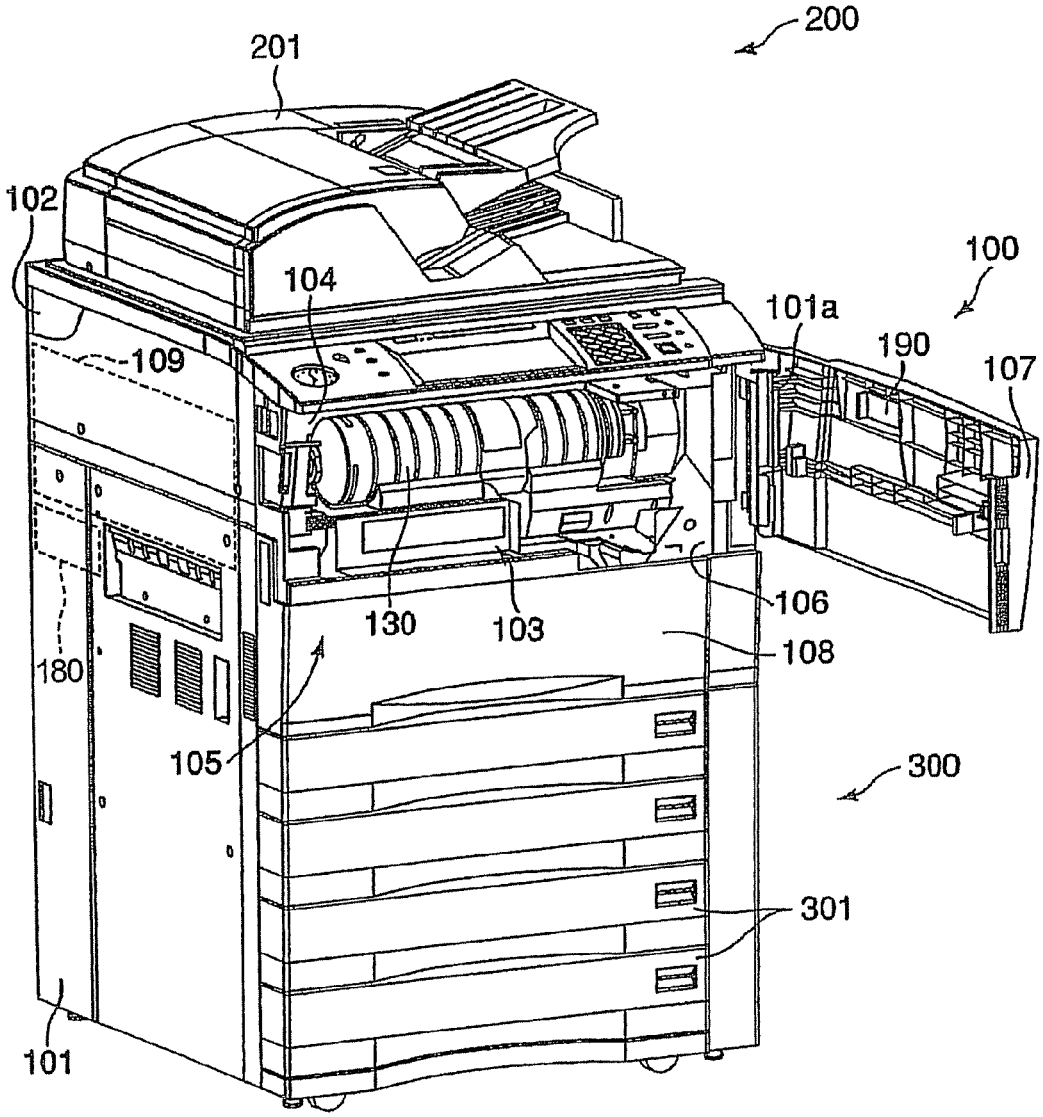
FIG. 2 is a perspective view showing the condition that the opening of the electro-photographic copier relating to the same embodiment is opened.

FIG. 2 is a perspective view showing the condition that upper cover 107 of the electro-photographic copier relating to the same embodiment is opened. As shown in FIG. 2, main body unit 100 has main body case 101. Main body case 101 has a rectangular box shape and dividing wall 104 for separating the internal space of main body case 101 to rear space 102 and front space 103 is provided internally. Further, as a material of dividing wall 104, a metal such as aluminum is used.

On front wall (wall) 105 of main body case 101, opening 106 is formed. Opening 106 has a rectangular shape extending in the horizontal direction and on the front of main body unit 101, upper cover 107 and lower cover 108 for opening and closing opening 106 are provided.

Upper cover 107 and lower cover 108 are supported rotatably by vertical shaft 101*a* arranged on the left side of main body case 101. Further, upper cover 107 is arranged at the height corresponding to toner cartridge 130 mounted in main body unit 100. Therefore, when exchanging toner cartridge 130, an operator may rotate upper cover 107 and open only the upper half of opening 106.

On the inner surface of upper cover 107, discriminating key 190 for discriminating whether toner cartridge 130 mounted on main body unit 100 is a true product or not is provided. Further, toner cartridge 130 and discriminating key 190 are important points of the present invention, so that they will be explained later in detail.

In rear space 102, image forming stage 109 for forming a document image on a paper (transferred article) is arranged.

As mentioned above, there is dividing wall 104 between rear space 102 and front space 103, so that even if upper cover 107 and lower cover 108 are opened, image forming stage 109 will not be exposed externally.

In image forming stage 109, as is generally known, a rotatable photosensitive drum, a charger for charging the surface of the photosensitive drum, a laser unit for forming an electrostatic latent image on the surface of the photosensitive drum, a developing device for developing the electrostatic latent image on the photosensitive drum by toner, a transfer roller for transferring the toner image on the photosensitive drum onto a paper, a fixing device for applying heat and pressure to the paper on which the toner image is transferred and fixing the toner image on the paper, and a cleaner for removing residual toner on the photosensitive drum are arranged.

Figure 3:
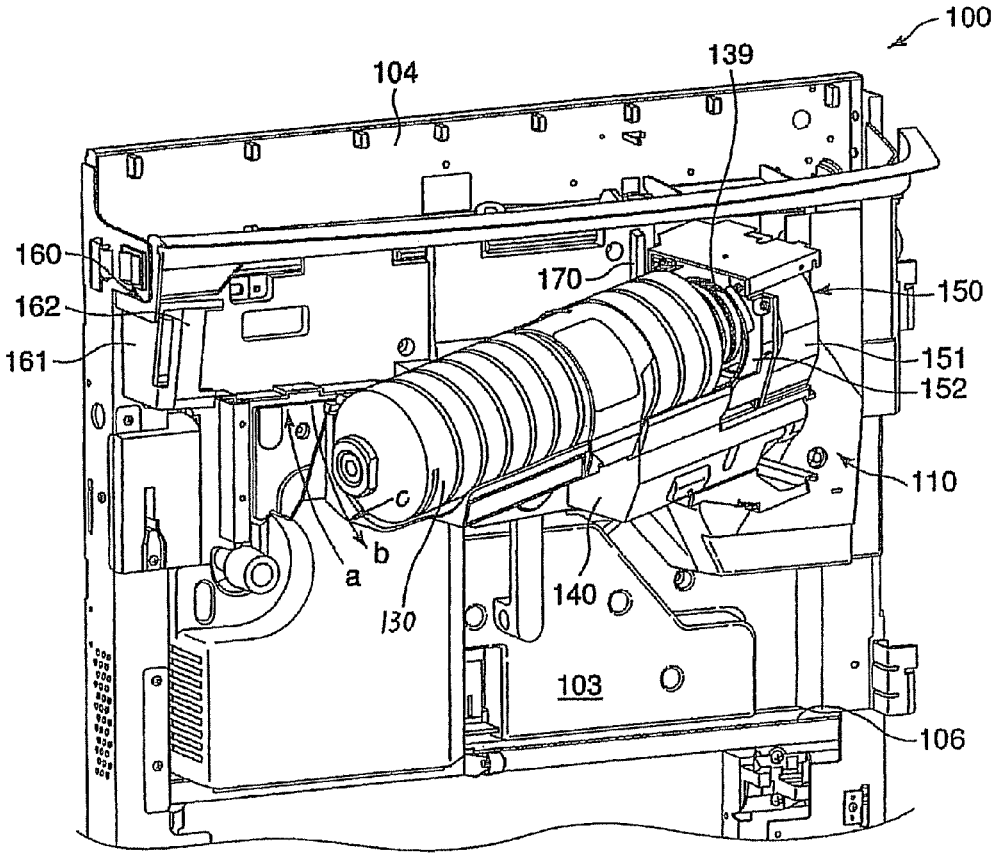
FIG. 3 is a perspective view showing the internal constitution of the front space relating to the same embodiment.

FIG. 3 is a perspective view showing the internal constitution of front space 103 relating to the same embodiment. As shown in FIG. 3, in front space 103, at the position corresponding to upper cover 107, toner replenishing portion 110 for supplying toner to image forming stage 109 is arranged. As mentioned above, on front wall 105 of main body case 101, opening 106 is formed, so that when upper cover 107 is open, toner replenishing portion 110 is exposed from opening 106.

In toner replenishing portion 110, cartridge holder 140 for holding removably toner cartridge 130, cartridge driver 150 for rotating toner cartridge 130 around the shaft center thereof, pusher 160 for pressing toner cartridge 130 mounted in main body unit 100 toward cartridge driver 150, and detector (detection portion) 170 for detecting projection portion 136*a* provided on cap portion (described later) 136 of toner cartridge 130 are arranged.

Cartridge holder 140 is supported rotatably by the connection section arranged on the right side in main body case 101. Toner cartridge 130 is mounted and demounted using the rotary operation of cartridge holder 140. Namely, when mounting toner cartridge 130 in main body unit 100, an operator allows cartridge holder 140 to hold toner cartridge 130 and then rotates cartridge holder 140 in the direction of arrow a together with toner cartridge 130. Further, when removing toner cartridge from main body unit 100, the operator rotates cartridge holder 140 in the direction of arrow b and projects toner cartridge 130 outside main body unit 100.

Cartridge driver 150 is arranged in the neighborhood of the connection section in cartridge holder 140. Cartridge driver 150 is composed of drive body 151 and coupling 152. Coupling 152 has a cylindrical shape and on the bottom thereof, concavity and convexity 152*a* (drawn in only FIG. 5) in a shape according to the kind and destination of the electrophotographic copier is formed.

Pusher 160 is arranged on the left side of main body case 101. Pusher 160 includes fixing member 161 fixed to main body case 101, pushing member 162 moving freely in the lateral direction of fixing member 161, and a spring provided between fixing member 161 and pushing member 162 for pressing fixing member 161 and pushing member 162 in the opposite direction to each other.

Pushing member 162 is restricted on the movement range thereof by the stopper provided on fixing member 161. Therefore, if toner cartridge 130 is long extremely, when mounting toner cartridge 130 in main body unit 100, the end of toner cartridge 130 and pusher 160 interfere with each other and toner cartridge 130 is not mounted perfectly.

Detector 170 is composed of the detector body and a button. The button is provided at the position opposite to flange portion 136 of bottle cap 132 and when the button is pushed by projection portion 136*a* (FIG. 5) provided on flange portion 136, the detector body outputs an electric signal for the period of pushing time.

Further, as shown in FIG. 2, inside main body case 101, controller (generator) 180 for controlling the copy operation of the electro-photographic copier is provided. Controller 180, in addition to the control for the copy operation, on the basis of the electric signal from detector body 171, infers the residual amount of toner of toner cartridge 130 and discriminates the kind of toner cartridge 130.

(Scanner Unit 200)

Scanner unit 200 is composed of a document tray for loading documents and a scanner for reading document images loaded on the document tray. The document tray is composed of a transparent glass plate fit into the top of the main body unit and on the upper part thereof, automatic document feeder 201 is arranged. The scanner is arranged under the document tray and includes mainly a light source for irradiating light to the document surface, a plurality of mirrors for sequentially reflecting light reflected from the document surface and changing its direction, and a light receiving element for receiving reflected light whose direction is changed by the plurality of mirrors.

(Paper Supply Unit 300)

Paper supply unit 300 is composed of a plurality of stages of paper supply cassettes 301. These paper supply cassettes 301 are arranged removably on the lower part of main body unit 100 and respectively store many papers. The papers inside paper supply cassettes 301 are conveyed to image forming stage 109 through the conveying route and document images are formed there.

(Toner Cartridge 130)

Figure 4:
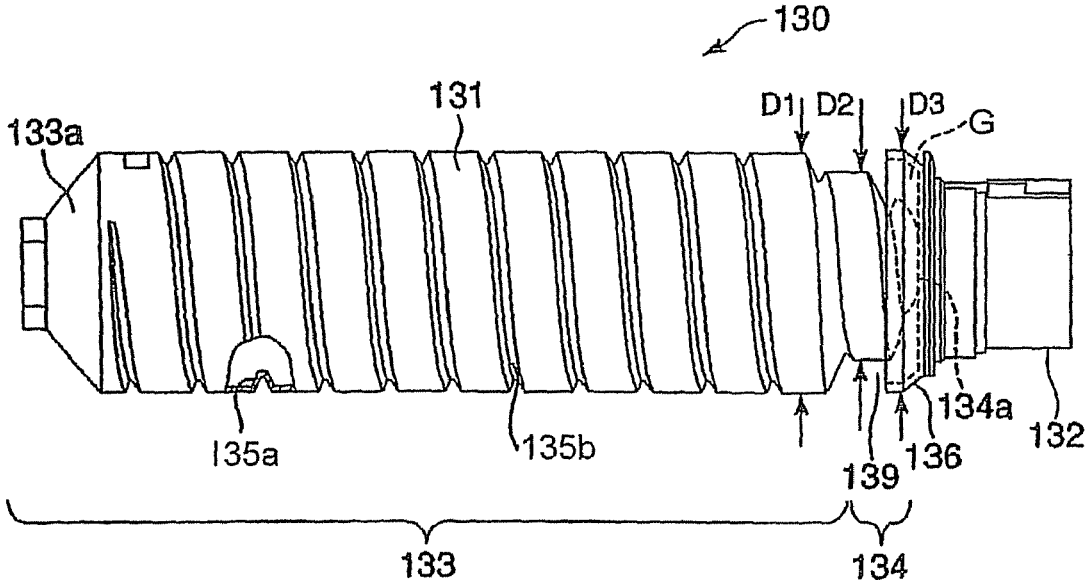
FIG. 4 is a front view showing the constitution of the toner cartridge relating to the same embodiment.

FIG. 4 is a front view showing the constitution of toner cartridge 130 relating to the same embodiment. As shown in FIG. 4, toner cartridge 130 is composed of toner bottle 131 for storing toner and bottle cap 132 for blocking opening 134a of toner bottle 131.

Toner bottle 131 is composed of first cylindrical portion 133 and second cylindrical portion 134. First cylindrical portion 133 has bottom wall 133*a*. Second cylindrical portion 134 is arranged on the opposite side of bottom wall 133*a* for first cylindrical portion 133 and at the position of second cylindrical portion 134 opposite to bottom wall 133*a*, opening 134*a* for ejecting toner is formed.

First and second cylindrical portions 133 and 134 are interconnected to each other and on the inner peripheral surfaces thereof, spiral projections 135*a* are formed. When toner cartridge 130 rotates, by the movement of spiral projection 135*a* on the inner peripheral surface of toner bottle 131, toner inside toner bottles 131 is conveyed toward opening 134*a*. Further, on the outer surface of toner bottle 131 corresponding to spiral projection 135*a*, spiral groove 135*b* is formed.

Figure 5:
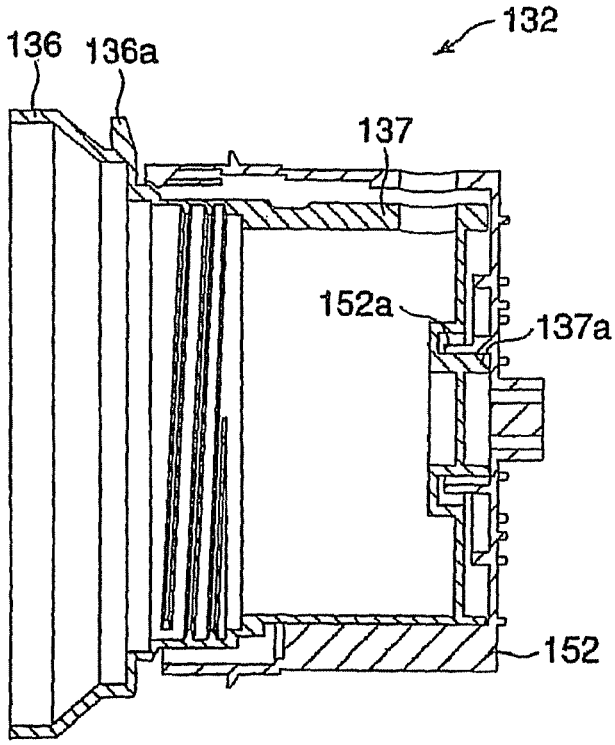
FIG. 5 is a cross sectional view showing the constitution of the bottle cap relating to the same embodiment.

FIG. 5 is a cross sectional view showing the constitution of bottle cap 132 relating to the same embodiment. As shown in FIG. 5, bottle cap 132 is composed of flange portion 136 and driven portion 137. Flange portion 136 is in a bowl shape and the end of second cylindrical portion 134 is stored internally. Flange portion 136 and second cylindrical portion 134 are fixed by screwing.

Further, the inside diameter of flange portion 136 is larger than the outside diameter of second cylindrical portion 134. Therefore, between the outer peripheral surface of second cylindrical portion 134 and the inner peripheral surface of flange portion 136, as shown in FIG. 4, gap G where air exists is formed.

Figure 11:
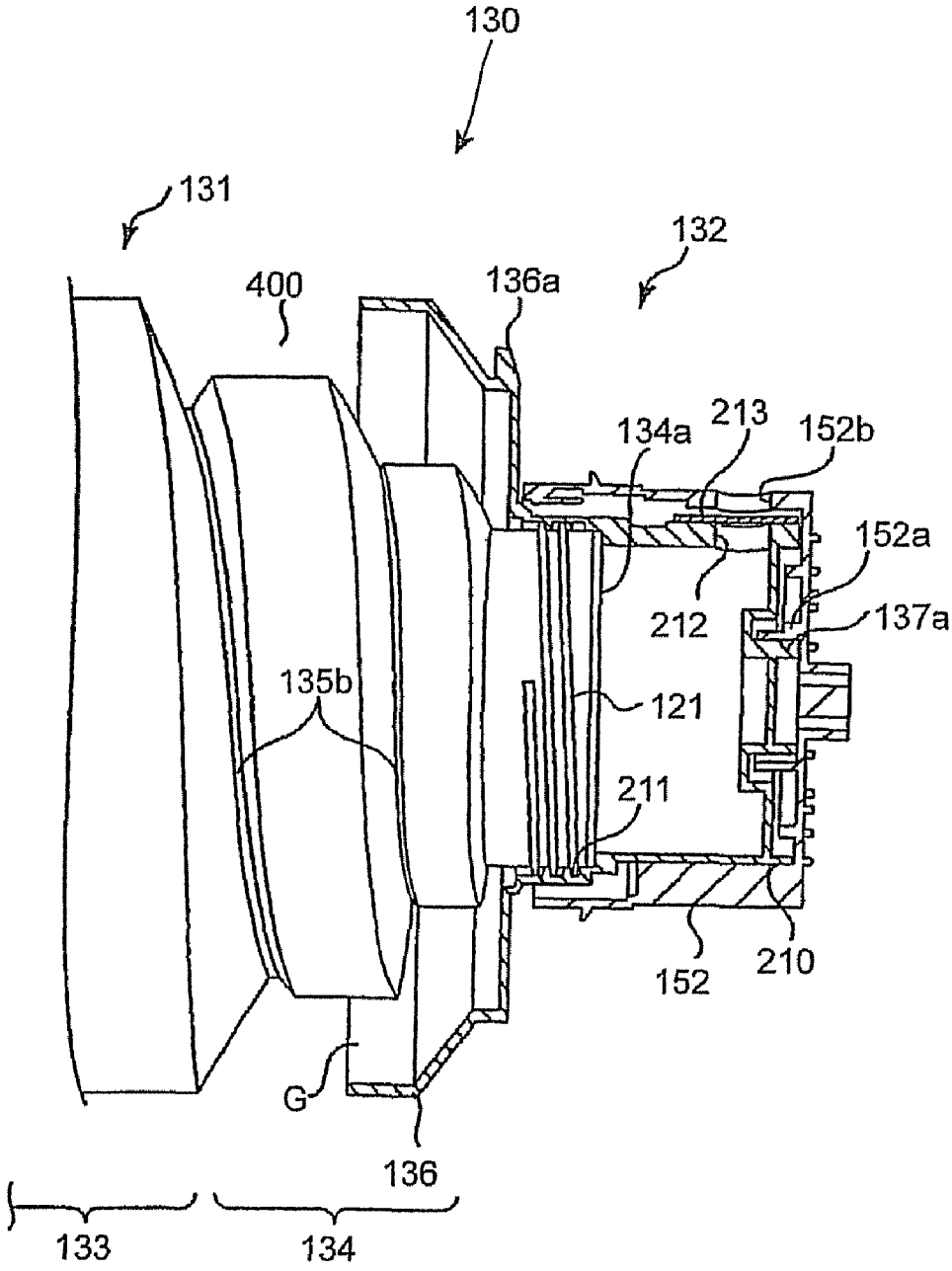
FIG. 11 is a cross sectional view showing the constitution of the bottle cap relating to the third embodiment of the present invention.

Further, as shown in FIG. 11, on the outer peripheral surface of flange portion 136, projection portion 136*a* in a shape according to the machine kind or destination is formed. Projection portion 136*a* rotates together with toner cartridge 130 and whenever facing detector 170 shown in FIG. 3, presses the button of detector 170.

Driven portion 137 is arranged on the opposite side of toner bottle 131 in flange portion 136. On the end surface of driven portion 137 on the opposite side of toner bottle 131, concavity and convexity (first concavity and convexity) 137*a* in a shape corresponding to the machine kind or destination, that is, corresponding to concavity and convexity (second concavity and convexity) 152*a* of coupling 152 is formed.

By doing this, when toner cartridge 130 is a true product, concavity and convexity 137*a* formed in driven portion 137 and concavity and convexity 152*a* formed in coupling 152 of cartridge driver 150 are perfectly fit to each other and toner cartridge 130 is held in the correct position of cartridge holder 140.

Inversely, when toner cartridge 130 is not a true product, concavity and convexity 137*a* formed in driven portion 137 and concavity and convexity 152*a* formed in coupling 152 of cartridge driver 150 are not fit into each other and toner cartridge 130 is projected from cartridge holder 140.

(Groove Portion 139)

Next, groove portion 139 will be explained. As shown in FIG. 4, assuming the outside diameter of first cylindrical portion 133 as D1, the outside diameter of second cylindrical portion 134 as D2, and the outside diameter of flange portion 136 as D3, the following relationships are established between D1, D2, and D3.

D1>D2 and D3>D2

Namely, second cylindrical portion 134 has a diameter smaller than those of first cylindrical portion 133 and flange portion 136 which are respectively arranged on both sides thereof. Therefore, on the outer peripheral surface of toner cartridge 130, between first cylindrical portion 133 and flange portion 136, circular groove portion 139 is formed. Groove portion 139 is specified by first cylindrical portion 133, second cylindrical portion 134, and flange portion 136. Therefore, by combination of outside diameter D1 of first cylindrical portion 133, outside diameter D2 of second cylindrical portion 134, and outside diameter D3 of flange portion 136, groove portions 139 in various shapes are formed.

(Discriminating Key 190)

Figure 6:
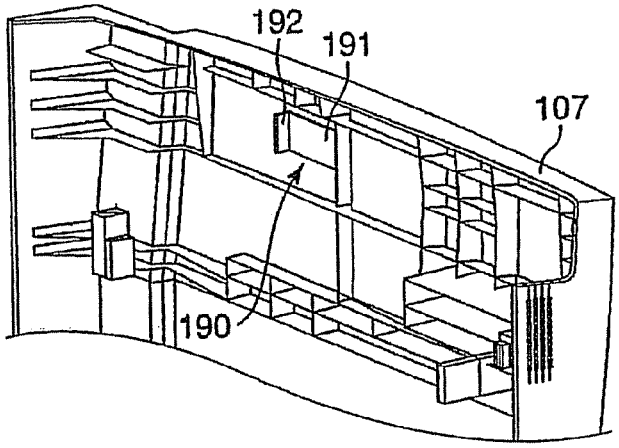
FIG. 6 is a perspective view showing the discriminating key attached to the upper cover relating to the same embodiment.

Next, discriminating key 190 will be explained. FIG. 6 is a perspective view of discriminating key 190 attached to upper cover 107 relating to the same embodiment. As shown in FIG. 6, discriminating key 190 is composed of base portion 191 fixed to the inner surface of upper cover 107 and projection plate (projection portion) 192 projecting toward toner cartridge 130 when upper cover 107 closes perfectly opening 106. Projection plate 192 is arranged at the position corresponding to groove portion 139 of toner cartridge 130. The material of discriminating key 190 is not particularly limited, though for example, a moldable material such as resin is used. Further, discriminating key 190 is not limited to a plate-like member such as projection plate 192 but may be a columnar member or any other projecting member.

(Relationship Between Groove Portion 139 and Discriminating Key 190)

Figure 7:
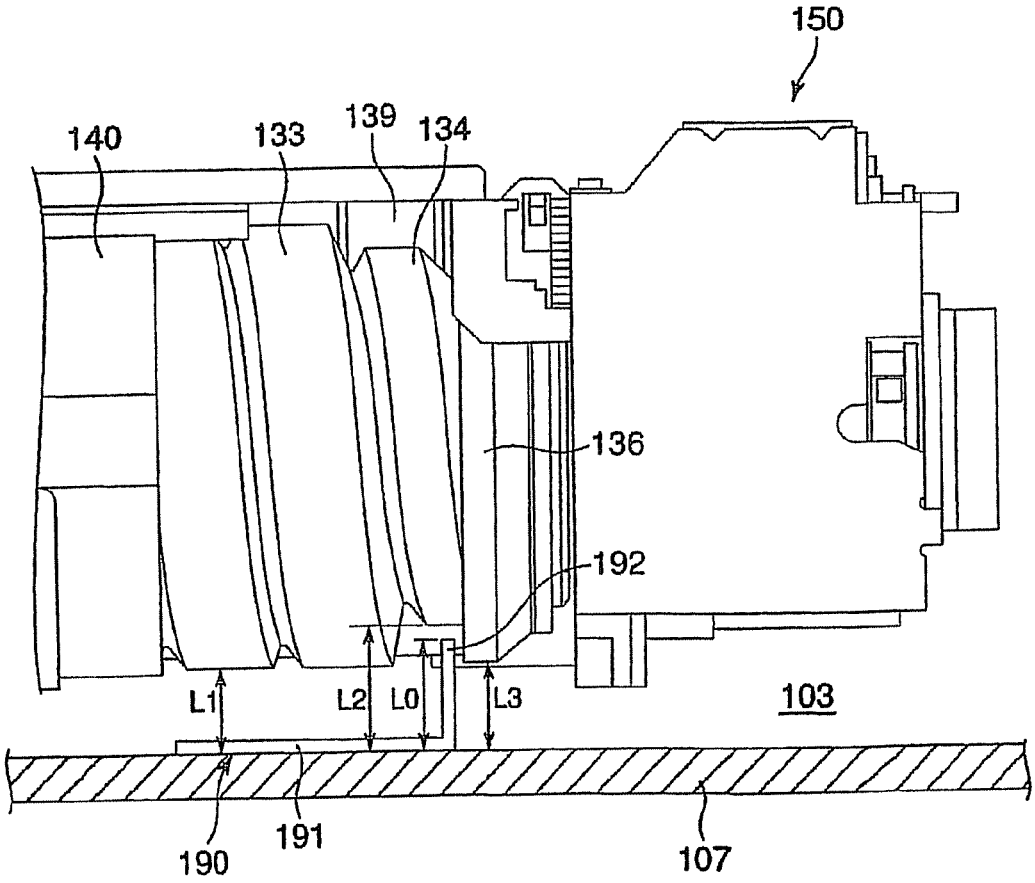
FIG. 7 is a plan view showing the condition that the projection plate of the discriminating key relating to the same embodiment gets into the groove portion of the toner cartridge.

Next, the relationship between groove portion 139 and discriminating key 190 will be explained. FIG. 7 is a plan view showing the condition that projection plate 192 of discriminating key 190 relating to the same embodiment gets into groove portion 139 of toner cartridge 130 and FIG. 8 is a perspective view showing the condition that projection plate 192 of discriminating key 190 relating to the same embodiment gets into groove portion 139 of toner cartridge 130.

Assuming the distance from the inner surface of upper cover 107 to the front end of projection plate 192 as L0, the distance from the inner surface of upper cover 107 to the outer peripheral surface of first cylindrical portion 133 as L1, the distance from the inner surface of upper cover 107 to the outer peripheral surface of second cylindrical portion 134 as L2, and the distance from the inner surface of upper cover 107 to the outer peripheral surface of flange portion 136 as L3, the following relationships are established between L0 to L3.

L1<L0<L2 and L3<L0<L2

Figure 8:
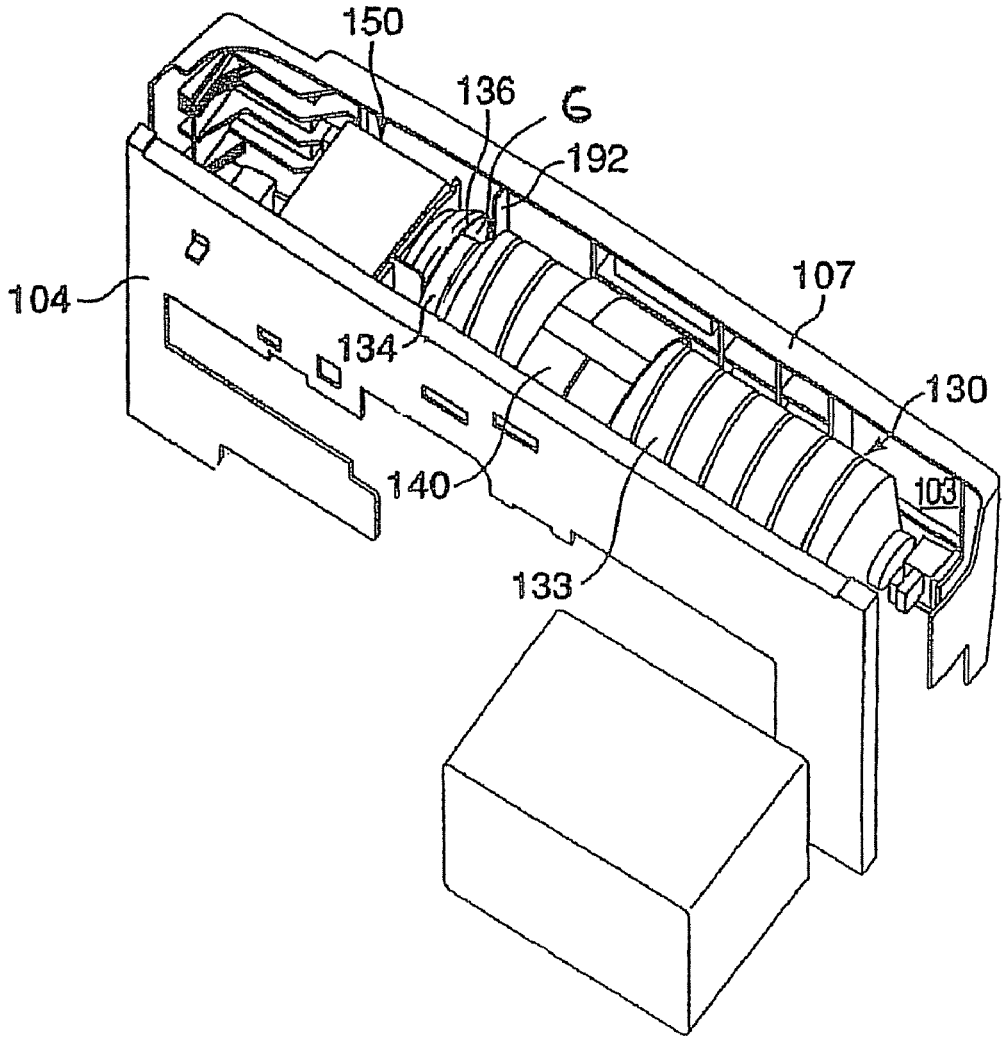
FIG. 8 is a perspective view showing the condition that the projection plate of the discriminating key relating to the same embodiment gets into the groove portion of the toner cartridge.

Therefore, as shown in FIGS. 7 and 8, if toner cartridge 130 mounted in main body unit 100 is a true product, when upper cover 107 is closed, projection plate 192 of discriminating key 190 gets into groove portion 139 of toner cartridge 130.

However, if toner cartridge 130 mounted in main body unit 100 does not have groove portion 139, in the middle of approaching opening 106 of main body case 101 by upper cover 107, toner cartridge 130 and projection plate 192 interfere with each other and upper cover 107 is not closed perfectly.

Further, even if toner cartridge 130 has groove portion 139, unless the position of groove portion 139 corresponds to the position of projection plate 192 of discriminating key 190, in the middle of approaching opening 106 of main body case 101 by upper cover 107, toner cartridge 130 and projection plate 192 interfere with each other and upper cover 107 is not closed perfectly as well.

Further, as a concrete example that the position of groove portion 139 does not correspond to the position of projection plate 192, a case may be cited that concavity and convexity 137*a* formed on driven portion 137 does not correspond to concavity and convexity 152*a* formed on coupling 152, thus driven portion 137 is not inserted sufficiently into coupling 152.

Namely, even if toner cartridge 130 mounted has groove portion 139 in the same shape at the same position as those of the true product, unless concavity and convexity 137*a* of driven portion 137 corresponds perfectly to concavity and convexity 152*a* of coupling 152, upper cover 107 is not closed.

Furthermore, when groove portion 139 is excessively shallow even if toner cartridge 130 has groove portion 139 and the position of groove portion 139 of toner cartridge 130 corresponds to the position of projection plate 192 of discriminating key 190, that is, when the outside diameter D2 of second cylindrical portion 134 is excessively large, in the middle of approaching opening 106 of main body case 101 by upper cover 107, toner cartridge 130 and projection plate 192 interfere with each other and upper cover 107 is not closed perfectly.

(Operation of this Embodiment)

On the inner surface of upper cover 107 of this embodiment, at the position according to the kind and destination of the electro-photographic copier, projection plate 192 with a length according to the machine kind and destination is provided.

Therefore, unless toner cartridge 130 mounted in main body unit 100 has groove portion 139 in the same form as that of the true product at the same position as that of the true product, toner cartridge 130 and projection plate 192 interfere with each other and upper cover 107 is not closed perfectly. Therefore, an operator can recognize surely that toner cartridge 130 mounted is not a true product.

Moreover, in this embodiment, on driven portion 137 of bottle cap 132 and coupling 152 of cartridge driver 150, concavities and convexities 137*a* and 152*a* in the shape according to the kind and destination of the electro-photographic copier are formed respectively.

Therefore, when toner cartridge 130 mounted in main body unit 100 is not a true product, defective fitting is generated between concavity and convexity 137*a* of driven portion 137 and concavity and convexity 152*a* of coupling 152 and the position of groove portion 139 of toner cartridge 130 is shifted from the position of projection plate 192 of upper cover 107. If the position of groove portion 139 is shifted from the position of projection plate 192, projection plate 192 and toner cartridge 130 naturally interfere with each other and upper cover 107 is not closed perfectly.

Therefore, even if toner cartridge 130 has groove portion 139 in the same form as that of the true product, unless concavity and convexity 137*a* of driven portion 137 perfectly corresponds to concavity and convexity 152*a* of coupling 152, upper cover 107 is not closed perfectly. Therefore, the operator can recognize more surely that toner cartridge 130 mounted is not a true product.

Further, groove portion 139 in this embodiment is specified by first cylindrical portion 133, second cylindrical portion 134, and flange portion 136. Therefore, according to the fixing way of second cylindrical portion 134 and flange portion 136, the width of groove portion 139 varies freely. Therefore, toner cartridges 130 of kinds sufficiently corresponding to many machine kinds and many destinations are manufactured.

Furthermore, in this embodiment, between the outer peripheral surface of second cylindrical portion 134 and the inner peripheral surface of flange portion 136, gap G where air exists is formed. Therefore, even if heat from the fixing device is transferred to toner cartridge 130 through dividing wall 104, air in gap G functions as a cooling member and toner in toner bottle 131 is prevented from overheating. Therefore, a situation that toner in toner bottle 131 is fused, which is a conventional problem, is not generated.

Furthermore, even if toner leaks from the gap between toner bottle 131 and bottle cap 132, the leaked toner is immediately ejected from gap G. As a result, failures of toner cartridge 130 are discovered immediately after manufacture, that is, before shipment. Therefore, useless transport is reduced.

Further, the electro-photographic copier of this embodiment is of a simple constitution obtained only by adding discriminating key 190 to the conventional electro-photographic copier and no electric means such as a switch for detecting whether toner cartridge 130 is a true product or not is required. Therefore, the constitution of the electro-photographic copier is not complicated and furthermore, the expense required to introduce the present invention can be controlled extremely low.

As mentioned above, according to the electro-photographic copier of the present invention, use of toner cartridge 130 which is not a true product can be prevented surely at a low cost. As a result, compared with the conventional, occurrences of print failures and equipment failures are reduced greatly.

Further, in this embodiment, to close opening 106, upper cover 107 and lower cover 108 are used. However, the present invention is not limited to it and one cover may be good enough.

[Second Embodiment]

Figure 9:
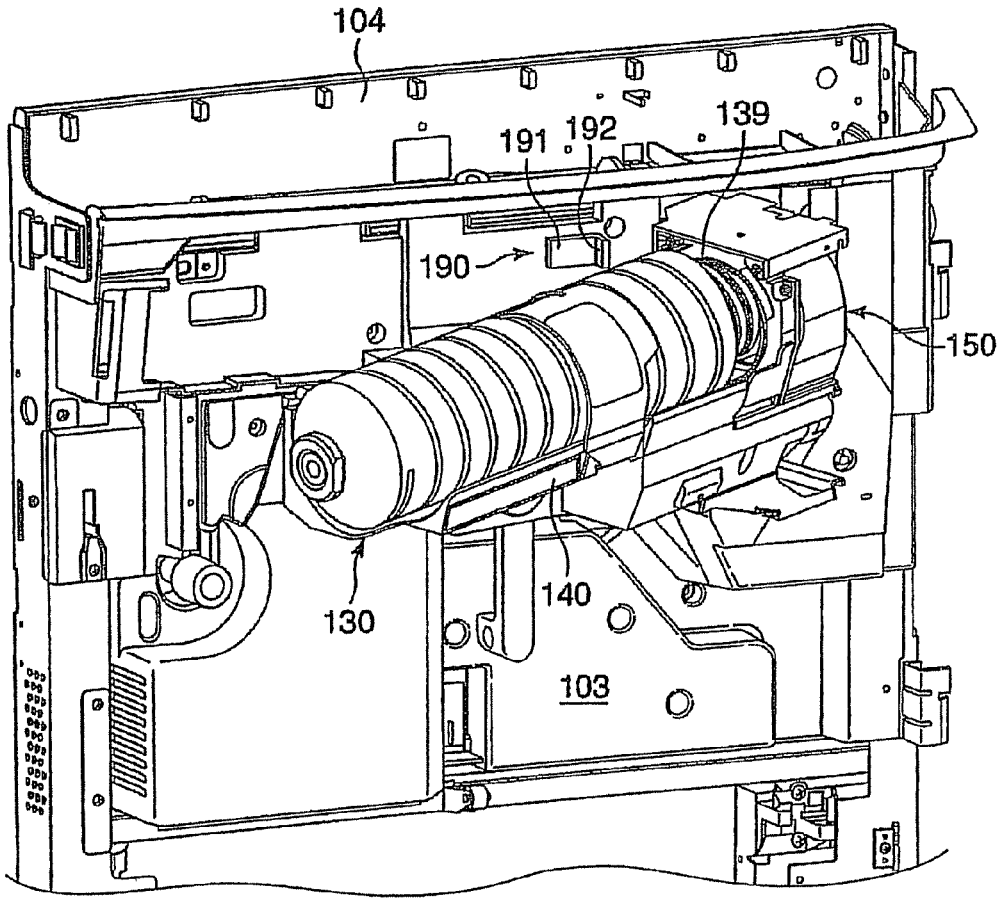
FIG. 9 is a perspective view showing the internal constitution of the front space relating to the second embodiment of the present invention.
Figure 10:
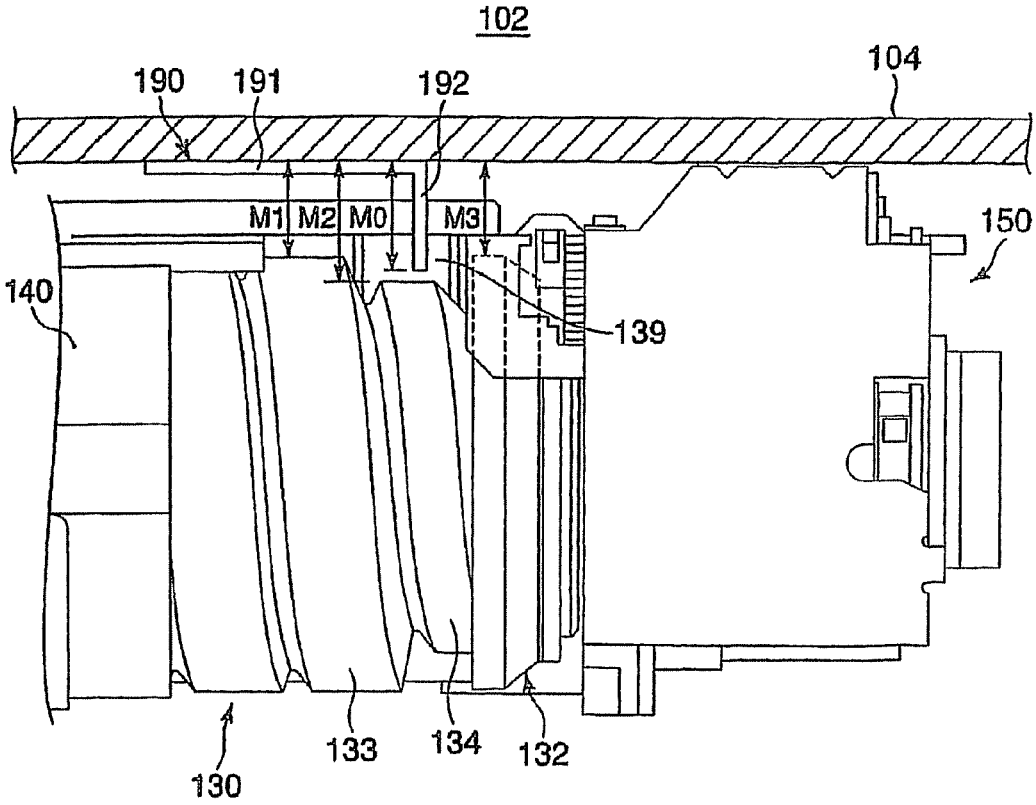
FIG. 10 is a plan view showing the condition that the projection plate of the discriminating key relating to the same embodiment gets into the groove portion of the toner cartridge.

Next, the second embodiment will be explained in detail by referring to FIGS. 9 and 10. Further, for the similar constitution and operation to those of the first embodiment, the explanation will be omitted. FIG. 9 is a perspective view showing the internal constitution of front space 103 relating to the second embodiment of the present invention and FIG. 10 is a plan view showing the condition that projection plate 192 of discriminating key 190 relating to the same embodiment gets into groove portion 139 of toner cartridge 130.

As shown in FIG. 9, discriminating key 190 in this embodiment is fixed to the front of dividing wall 104 instead of the inner surface of upper cover 107. Projection plate 192 of discriminating key 190 is arranged at the position corresponding to groove portion 139 of toner cartridge 130.

Next, the relationship between projection plate 192 and groove portion 139 will be explained. Assuming the distance from the front of dividing wall 104 to the front end of projection plate 192 as M0, the distance between the front of dividing wall 104 and the outer peripheral surface of first cylindrical portion 133 as M1, the distance between the front of dividing wall 104 and the outer peripheral surface of second cylindrical portion 134 as M2, and the distance between the front of dividing wall 104 and the outer peripheral surface of flange portion 136 as M3, the following relationships are established between M0 to M3.

$M1<M0<M2$ and $M3<M0<M2$

Therefore, as shown in FIG. 10, when toner cartridge 130 which is a true product is mounted in main body unit 100, projection plate 192 of discriminating key 190 gets into groove portion 139 of toner cartridge 130 without making contact with toner cartridge 130.

However, if toner cartridge 130 does not have groove portion 139, in the middle of mounting toner cartridge 130 in main body unit 100, toner cartridge 130 and projection plate 192 interfere with each other and toner cartridge 130 cannot be mounted perfectly.

Even if toner cartridge 130 has groove portion 139, unless the position of groove portion 139 corresponds to the position of projection plate 192 of discriminating key 190, in the middle of mounting toner cartridge 130, toner cartridge 130 and projection plate 192 interfere with each other and toner cartridge 130 cannot be mounted perfectly as well.

Further, as a concrete example that the position of groove portion 139 does not correspond to the position of projection plate 192, a case may be cited that the shape of concavity and convexity 137*a* of bottle cap 132 does not correspond to concavity and convexity 152*a* of cartridge driver 150, thus groove portion 139 of toner cartridge 130 mounted in main body unit 100 is shifted from the position of projection plate 192.

Further, even if the position of groove portion 139 corresponds to the position of projection plate 192, when groove portion 139 is shallow excessively, that is, when the outside diameter of second cylindrical portion 134 is excessively large, in the middle of mounting toner cartridge 130, toner cartridge 130 and projection plate 192 interfere with each other and toner cartridge 130 is not mounted perfectly.

Namely, unless the position and depth of groove portion 139 formed in toner cartridge 130 and the shape of concavity and convexity 137*a* formed on driven portion 137 correspond to the kind of the electro-photographic copy, toner cartridge 130 is not mounted perfectly. Therefore, the operator can recognize surely that toner cartridge 130 is not a true product, so that a situation that toner cartridge 130 which is not a true product is used is reduced greatly.

As mentioned above, even if discriminating key 190 is provided on dividing wall 104, the same effect as that of the first embodiment is obtained.

[Third Embodiment]

FIG. 11 shows the constitution of the essential section of toner cartridge 130 relating to the third embodiment. As shown in FIG. 11, at the edge of opening 134*a* formed in toner bottle 131, male screw 121 to be engaged with internal thread 211 formed in cap portion 210 of bottle cap 132 is formed. Further, toner bottle 131 and bottle cap 132 are assembled at time of manufacture of toner cartridge 130 but not assembled by a user after commercialization.

Bottle cap 132 is composed of cylindrical cap portion 210 with a bottom connected to second cylindrical portion 134, which is a contracting diameter portion of toner bottle 131, so as to cover opening 134a and bowl-shaped flange portion 136 for storing a part of second cylindrical portion 134.

Cap portion 210 is a portion stored in coupling (driver) 152 of cartridge driver 150 (FIG. 3) provided in the image forming apparatus. On the inner peripheral surface of the edge of cap portion 210, internal thread 211 to be engaged with male screw 121 formed on the outer peripheral surface of opening 134*a* is formed. Further, on the peripheral wall of cap portion 210, vent 212 for ejecting toner from toner bottle 131 to a developing device (not drawn) of the image forming apparatus is formed. Furthermore, on the end surface of cap portion 210, concavity and convexity 137*a* in a shape according to the kind of toner cartridge 130 is formed. Further, also in coupling 152 of cartridge driver 150 provided in the image forming apparatus, concavity and convexity 152*a* is formed. Namely, only when concavity and convexity 137*a* of toner cartridge 130 mounted and concavity and convexity 152*a* of coupling 152 are perfectly fit to each other, toner cartridge 130 is mounted correctly. Further, on the outer peripheral surface of cap portion 210, shutter 213 for sliding in the direction of the shaft center of toner bottle 131 and opening or closing vent 212 is provided. Shutter 213 is opened only when toner cartridge 130 is correctly mounted in the image forming apparatus. Further, toner ejected from vent 212 is supplied to a developing device (not drawn) through opening 152*b* formed on the peripheral wall of coupling 152.

The edge of flange portion 136 is extended toward first cylindrical portion 133 of toner bottle 131 almost in parallel with the outer peripheral surface of second cylindrical portion 134 which is a contracting diameter portion. Therefore, between the inner peripheral surface of flange portion 136 and the outer peripheral surface of second cylindrical portion 134, gap G where air exists is formed. Further, on the outer peripheral surface of flange portion 136, projection portion 136*a* in a shape according to the kind of toner cartridge 130 is formed. Projection portion 136*a*, as shown in FIG. 3, is detected by detector 170 provided on main body unit 100 of the image forming apparatus and the detection result is used to infer the residual amount of toner of toner cartridge 130 and discriminate the kind of toner cartridge 130.

(Constitution of Groove Portion 400)

Next, groove portion 400 which is an important point of the present invention will be explained.

The outside diameter of second cylindrical portion 134, even at the part which is closest to first cylindrical portion 133 and has a largest diameter, is designed so as to be smaller than the outside diameter of first cylindrical portion 133 and the outside diameter of flange portion 136. By doing this, on the outer peripheral surface of toner cartridge 130, circular groove portion 400 is formed. The depth and width of groove portion 400 are specified by first cylindrical portion 133, second cylindrical portion 134, and flange portion 136 and are set so that a user of the image forming apparatus can put his finger on groove portion 400.

(Removal Operation for Toner Cartridge 130)

Next, the removal operation for toner cartridge 130 will be explained. As shown in FIG. 3, when cartridge holder 140 is pulled out toward the operator's side for each toner cartridge 130, the user puts his finger on groove portion 400 of toner cartridge 130 and pulls out toner cartridge 130 in the direction of arrow c. By doing this, toner cartridge 130 slides and moves against cartridge holder 140 and finally removes from the image forming apparatus.

(Operation of this Embodiment)

On the outer peripheral surface of toner cartridge 130 of this embodiment, circular groove portion 400 is formed by first cylindrical portion 133, second cylindrical portion 134, and flange portion 136. Therefore, when exchanging toner cartridge 130, the user puts his finger on groove portion 400 and can pull out it from the image forming apparatus. Therefore, compared with conventional toner cartridge 130, the removal operation for toner cartridge 130 can be simplified greatly.

Further, on the inner peripheral surface of toner bottle 131 of this embodiment, spiral projection 135*a* for conveying the toner in toner bottle 131 toward opening 134*a* extending over first cylindrical portion 133 and second cylindrical portion 134 is formed. Namely, in this embodiment, also on the inner peripheral surface of second cylindrical portion 134, spiral projection 135*a* is formed. Therefore, even if the inside diameter of toner bottle 131 contracts as it approaches opening 134*a*, the toner stored in second cylindrical portion 134 is scraped out forcibly, so that the toner in toner bottle 131 will not stay in second cylindrical portion 134.

Further, in this embodiment, between the outer peripheral surface of second cylindrical portion 134 of toner bottle 131 and the inner peripheral surface of flange portion 136 of bottle cap 132, predetermined gap G is formed. Therefore, as shown in FIG. 8, even if heat from the fixing device provided in main body unit 100 of the image forming apparatus is transferred to toner cartridge 130 through dividing wall 104, air existing in gap G functions as a heat insulator. By doing this, the toner in toner bottle 131 is not fused. Moreover, even if toner leaks from toner cartridge 130 manufactured, the concerned toner is ejected immediately from toner cartridge 130 through gap G, so that the manufacturer of toner cartridge 130 can recognize the toner leakage surely and promptly. As a result, toner cartridge 130 from which toner leaks is prevented from shipment and the unnecessary transport cost is lowered.

Figure 12:
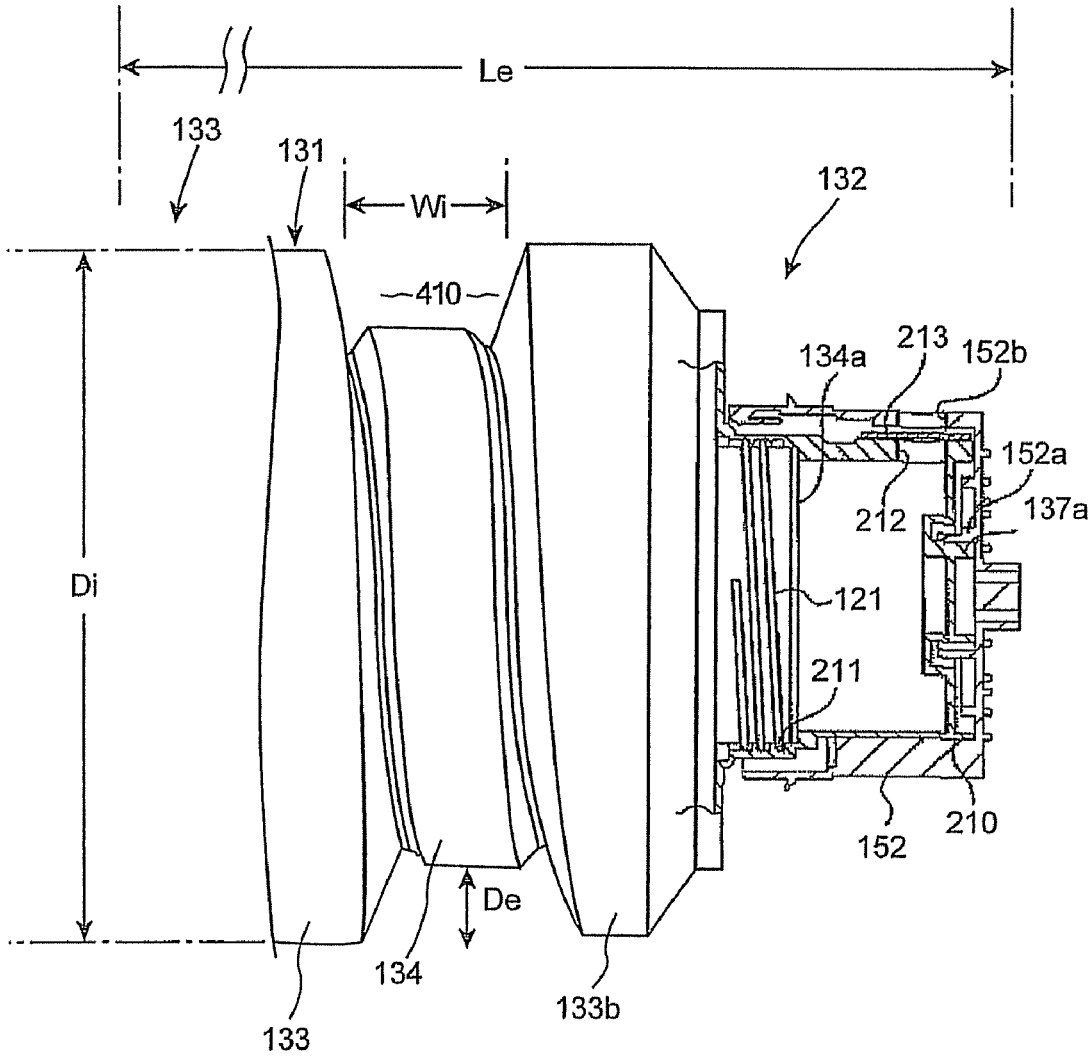
FIG. 12 is a front view showing a part of the toner cartridge relating to the fourth embodiment of the present invention.

In the third embodiment aforementioned, between first cylindrical portion 133 and flange portion 136, circular groove portion 400 is formed, though in the fourth embodiment, it may be formed as shown in FIG. 12.

Namely, at the part of toner bottle 131, where flange portion 136 in the third embodiment is provided as a part thereof, third cylindrical portion 133*b* having an external dimension larger than outside diameter D2 of second cylindrical portion 134 shown in the third embodiment and almost equal to outside diameter D1 of first cylindrical portion 133 is formed. By doing this, between first cylindrical portion 133 and third cylindrical portion 133*b*, circular groove portion 410 is formed. A developer is stored also in third cylindrical portion 133*b*, so that it functions as a second developer storage portion. Therefore, in third cylindrical portion 133*b*, opening 134*a* for ejecting a developer is formed.

With respect to circular groove portion 410, similarly to the third embodiment, the depth and width of groove portion 410 are set so that a user of the image forming apparatus can put his finger on groove portion 410. Namely, as an embodiment, toner bottle 131 has full length Le of about 50 cm, cylinder diameter Di of about 11 cm, depth De of circular groove portion 410 of about 2 cm, and width Wi of groove portion 410 of about 4 cm. Therefore, when exchanging toner cartridge 130, the user, similarly to the third embodiment, can pull out it from the image forming apparatus by putting his finger on groove portion 410. The dimensions of the units aforementioned are just an illustration and the present invention is not limited to it. Further, as shown in FIG. 4, on the inner peripheral surface of toner bottle 131, spiral projection 135*a* is formed from bottom wall 133*a* toward opening 134*a* so as to convey toner by rotation of toner bottle 131. On the outer surface of toner bottle 131 corresponding to spiral projection 135*a*, spiral groove 135*b* is formed. However, since the width of groove portion 135*b* is about 7 mm and the depth thereof is about 5 mm, the user cannot put his finger on it unlike circular groove portion 410.

Furthermore, circular groove portion 410 is provided on the side of cartridge driver 150 from the central part of toner bottle 131 in the longitudinal direction instead of on the opposite side of cartridge driver 150, so that an effect such that the rotation operation of toner cartridge 130 can be performed stably is produced.

Although, as shown in FIG. 11, predetermined gap G is defined between second cylindrical portion 134 of toner bottle 131 and the inner surface of flange portion 136, the present invention is not limited to that structure. For example, bottle cap 132 may be so thick in thickness to contact with the outer surface of second cylindrical portion 134 except portions of circular groove portion 400 that gap G is not defined. In short, it is essential to form groove portion 400 in any case.

The present invention is not limited straight to the embodiments aforementioned and at the execution stage, without deviated from the objects of the present invention, the components may be modified and materialized. Further, by appropriate combination of a plurality of components disclosed in the embodiments aforementioned, various inventions can be realized. For example, from all the components indicated in the embodiments, several components may be deleted. Furthermore, components extending over different embodiments may be combined appropriately.

According to the present invention, use of a toner cartridge which is not a true product can be prevented surely at a low cost.

Furthermore, according to the present invention, the removal operation for the toner cartridge can be performed simply and stored toner is conveyed smoothly to the vent.

What is claimed is:

1. A toner bottle having a rotating axis, comprising:
- a cylindrical bottle portion to store toner;
- a bottle cap provided at one end in a longitudinal direction of the bottle portion;
- the bottle portion including,
  - a cylindrical portion,
  - a contracting diameter portion with a smaller diameter than a diameter of the cylindrical portion which is provided continuously with the cylindrical portion,
  - a spiral portion provided in the cylindrical portion and the contracting diameter portion to convey the toner in the toner bottle, and
  - a first engaging portion to engage with the bottle cap;
- the bottle cap including,
  - a cap portion having an ejection opening to eject the toner from the toner bottle which engages with the contracting diameter portion,
  - a second engaging portion to engage with the first engaging portion,
  - a bowl-shaped flange portion in which distances from the rotating axis become larger in a direction from a vicinity of the second engaging portion toward an end portion at the cylindrical portion side of the contracting diameter portion; and
- a gap being formed between an inner circumference surface of the flange portion and an outer circumference surface of the contracting diameter portion when the first engaging portion engages with the second engaging portion.

2. The toner bottle according to claim 1, wherein:
- the bowl-shaped flange portion is composed of a portion in which the distances from the contracting diameter portion become larger and a portion provided continuously with this portion which is in parallel with the contracting diameter portion.

3. The toner bottle according to claim 1, wherein:
- the gap is formed as an adiabatic air layer between the inner circumference surface of the flange portion and the outer circumference surface of the contracting diameter portion.

4. The toner bottle according to claim 1, wherein:
- the bottle cap further including a projection portion formed on an outer peripheral surface of the flange portion, the projection portion is a different formation according to the type of toner bottle.

5. The toner bottle according to claim 4, wherein a shape of the projection portion is determined according to at least either of a kind and a destination of an image forming apparatus to which the toner bottle is mounted.

6. The toner bottle according to claim 1, wherein the outer peripheral surface of the bottle cap, a shutter for sliding in a direction of a shaft center and opening or closing the ejection opening is provided.

7. An image forming apparatus, comprising:
- a main body having an opening and an image firming stage internally provided;
- a cover provided on the main body so as to open or close the opening; and
- a toner bottle to be mounted in the main body when the cover is opened,
- wherein the toner bottle includes:
  - a cylindrical bottle portion to store toner; and
  - a bottle cap provided at one end in the longitudinal direction of the bottle portion;
  - the bottle portion including,
    - a cylindrical portion,
    - a contracting diameter portion with a smaller diameter than a diameter of the cylindrical portion which is provided continuously with the cylindrical portion,
    - a spiral portion provided in the cylindrical portion and the contracting diameter portion to convey the toner in the toner bottle, and
    - a first engaging portion to engage with the bottle cap;
  - the bottle cap including,
    - a cap portion having an ejection opening to eject the toner from the toner bottle which engages with the contracting diameter portion,
    - a second engaging portion to engage with the first engaging portion, and
    - a bowl-shaped flange portion in which distances from the contracting diameter portion become larger in a direction from a vicinity of the second engaging portion toward an end portion at the cylindrical portion side of the contracting diameter portion;
- wherein when the first engaging portion engages with second engaging portion, a gap is formed between an inner circumference surface of the flange portion and an outer circumference surface of the contacting diameter portion.

8. The apparatus according to claim 7, wherein:
- the bowl-shaped flange portion is composed of a portion in which the distances from the contracting diameter portion become larger and a portion provided continuously with this portion which is in parallel with the contracting diameter portion.

9. The apparatus according to claim 7, wherein:

the gap is formed as an adiabatic air layer between the inner circumference surface of the flange portion and the outer circumference surface of the contracting diameter portion.

10. The apparatus according to claim 7, wherein:

the bottle cap further including a projection portion formed on an outer peripheral surface of the flange portion, the projection portion is a different formation according to the type of toner bottle.

11. The apparatus according to claim 10, wherein a shape of the projection portion is determined according to at least either of a kind and a destination of an image forming apparatus to which the toner bottle is mounted.

12. The apparatus according to claim 7, wherein the outer peripheral surface of the bottle cap, a shutter for sliding in a direction of a shaft center and opening or closing the ejection opening is provided.

* * * * *